US005651258A

United States Patent [19]

Harris

[11] Patent Number: 5,651,258

[45] Date of Patent: Jul. 29, 1997

[54] AIR CONDITIONING APPARATUS HAVING SUBCOOLING AND HOT VAPOR REHEAT AND ASSOCIATED METHODS

[75] Inventor: Bradford F. Harris, Winter Springs, Fla.

[73] Assignee: Heat Controller, Inc., Jackson, Mich.

[21] Appl. No.: 548,392

[22] Filed: Oct. 27, 1995

[51] Int. Cl.[6] ..... F25D 17/06; F25B 41/00

[52] U.S. Cl. ..... 62/90; 62/173; 62/196.4

[58] Field of Search ..... 62/90, 173, 196.4

[56] References Cited

U.S. PATENT DOCUMENTS

| | | | |
|---|---|---|---|
| Re. 26,695 | 10/1969 | Jensen | 62/173 |
| 3,139,735 | 7/1964 | Malkoff et al. | 62/90 X |
| 3,402,564 | 9/1968 | Nussbaum | 62/90 X |
| 3,738,117 | 6/1973 | Engel | 62/90 X |
| 4,270,362 | 6/1981 | Lancia et al. | 62/173 |
| 4,271,678 | 6/1981 | Liebert | 62/173 |
| 4,711,094 | 12/1987 | Ares et al. | 62/90 |
| 4,813,474 | 3/1989 | Umezu | 165/21 |
| 5,131,236 | 7/1992 | Wruck et al. | 62/173 |
| 5,181,552 | 1/1993 | Eiermann | 165/21 |
| 5,228,302 | 7/1993 | Eiermann | 62/90 |
| 5,231,845 | 8/1993 | Sumitani et al. | 62/160 |
| 5,265,433 | 11/1993 | Beckwith | 62/90 |
| 5,329,782 | 7/1994 | Hyde | 62/90 |
| 5,337,577 | 8/1994 | Eiermann | 62/173 |

OTHER PUBLICATIONS

*Information Package—Subcool and DeSuperheat Reheat System*, American Heat Pipes, Inc. (Feb. 1994).

*Primary Examiner*—William E. Wayne

*Attorney, Agent, or Firm*—Allen, Dyer, Doppelt, Milbrath & Gilchrist, P.A.

[57] ABSTRACT

An air conditioning apparatus includes a subcooling heat exchanger for subcooling refrigerant being delivered to an evaporator and for reheating air flow downstream from the evaporator; and a hot vapor heat exchanger, connectable in fluid communication with a refrigerant outlet of a compressor and positioned in the air flow downstream from the evaporator, for further reheating the air flow from the evaporator to further lower the relative humidity of the air flow. The air conditioning apparatus also preferably includes a hot vapor heat exchanger controller for selectively connecting the hot vapor heat exchanger in fluid communication with the refrigerant outlet of the compressor responsive to a sensed temperature. More particularly, the hot vapor heat exchanger controller may preferably include a solenoid valve connected in fluid communication between the hot vapor heat exchanger and the refrigerant outlet of the compressor, a thermostatic switch operatively connected to the solenoid valve for opening the solenoid valve when a temperature of air downstream from the hot vapor heat exchanger is below a predetermined temperature, a check valve connected in fluid communication with the hot vapor heat exchanger, and a differential pressure control valve connected in fluid communication between the compressor and the condenser and across the hot vapor heat exchanger for further controlling reheating by the hot vapor heat exchanger when the solenoid valve is open. Method aspects of the invention are also disclosed.

40 Claims, 4 Drawing Sheets

AIR CONDITIONING APPARATUS HAVING SUBCOOLING AND HOT VAPOR REHEAT AND ASSOCIATED METHODS

FIELD OF THE INVENTION

The present invention relates to the field of air conditioning, and, more particularly, to an air conditioning apparatus for reducing relative humidity.

BACKGROUND OF THE INVENTION

Air conditioning systems and equipment are widely used to achieve desirable indoor comfort levels for both temperature and relative humidity in residential, commercial, industrial, and office settings. It is becoming increasingly more desirable to increase the amount of fresh outside air delivered into an air conditioned space. The additional amount of outside air may be desirable for health reasons, such as to reduce the likelihood of so-called sick building syndrome. Moreover, proposed government standards require that current standards of 5 cubic feet per minute (CFM) of outside air per person be trebled to 15 CFM per person.

Unfortunately, it is likely to be difficult to deliver 15 CFM per person of outside air at a desired low relative humidity. A conventional air conditioner includes a condenser, an evaporator and a compressor for recirculating refrigerant through the condenser and evaporator. The evaporator, which is cooled by the evaporating refrigerant, cools the air but may also typically produce air that is essentially saturated with moisture. Because outside air typically contains a relatively large amount of moisture, requiring a greater flow rate of outside air creates an even greater difficulty in achieving a desirable humidity level in the conditioned air.

Lower relative humidity in air conditioned air is also desirable because it allows a higher thermostat set point while providing for the same level of human comfort. In addition, lower humidity levels in air supply ducts may reduce mold, bacteria growth, and allergic reactions. For example, the industrial organization American Society of Heating, Refrigerating, and Air Conditioning Engineers (ASHRAE) suggests that air entering air delivery ducts be no greater than 70% relative humidity.

Relative humidity is decreased by removing moisture from the air as is achieved by a conventional evaporator and by heating the air to increase its volume while maintaining a constant amount of water contained therein. Accordingly, electrical resistance heaters have been used to reheat conditioned air downstream from the evaporator to reduce the relative humidity of the air being delivered to the conditioned space. For example, U.S. Pat. No. 4,813,474 to Umezu discloses a conventional air conditioner including electric strip resistance heaters for reheating cooled air downstream from the evaporator, and wherein a controller calculates a difference between actual and desired temperature and humidity levels and operates the apparatus accordingly. Unfortunately, conventional electric resistance heaters, although simple to install and operate, consume a relatively large amount of energy. Moreover, in certain jurisdictions, such as the state of Florida, for example, electric reheat is proscribed by law in certain applications because of its increased energy consumption.

Other approaches have been attempted to obtain reheating of the air flow downstream of the evaporator yet prior to entering air delivery ducts. For example, U.S. Pat. No. 5,337,577 to Eirmann discloses an air conditioner including a pair of connected heat exchangers on the upstream and downstream sides of the evaporator through which water or some other fluid is pumped to provide reheat in a run-around configuration. Supplemental heat may be provided by heat recovered from the refrigeration process or by an alternative energy source, such as a gas or electric boiler, or water heater. See also U.S. Pat. Nos. 5,228,302 and 5,181,552 to Eirmann. Unfortunately, a run-around heat exchange system may result in an increased pressure drop of the air flow, requiring increased power consumption and thereby reducing the overall operating efficiency. In addition, the run-around configuration may not provide sufficient reheating to achieve a desired low humidity when using a large percentage of outside air.

U.S. Pat. No. 5,329,782 to Hyde discloses an air conditioner wherein a refrigerant pressure boosting pump is connected between an outlet of the condenser and a subcooling coil positioned adjacent the evaporator. The subcooling coil provides heat to the flow of inlet air, thereby decreasing its relative humidity. The extraction of heat from the liquid refrigerant also serves to increase the effective capacity of the compressor.

Along these lines, U.S. Pat. No. 5,265,433 to Beckwith discloses an air conditioner including a supplemental loop and reheat coil which delivers heat to incoming air via a heat exchanger coupled to the hot compressor exhaust line. A subcooling coil and supplemental loop are also used to reduce the temperature of liquid refrigerant from the condenser by 30° F. or more. Both of the heat exchangers disclosed in the Beckwith patent are phase change type heat exchangers wherein an intermediate phase change material is used to transfer heat.

Similarly, American Heat Pipes, Inc. of Auburndale, Fla. has offered an air conditioner including a subcooling coil and desuperheat reheat coil positioned in the flow of inlet air. The subcooling coil is directly connected in the refrigerant path to the evaporator. The desuperheat reheat coil provides additional controlled reheating to meet low cooling load conditions. The desuperheat reheat coil is coupled to the compressor discharge line via a heat pipe heat exchanger. The heat pipe heat exchanger is a phase change heat exchanger including a sealed tube charged with a precise amount of refrigerant to undergo a phase change and thereby transfer heat between the compressor discharge line and the desuperheat reheat coil. Unfortunately, as described above, a phase change heat exchanger may have reduced efficiency, be more difficult to control, and be relatively complex to install and maintain.

Also relating to control of relative humidity, Worthington Air Products of Palm Harbor, Fla. has offered an air conditioner comprising a plurality of subcooling coils, downstream from the evaporator, and connected in parallel with one another and a bypass. Selective operation of respective solenoid valves controls the amount of subcooling of the liquid refrigerant and thereby also controls the amount of air reheating. Unfortunately, while better control of reheating may be obtained, the system is relatively complex to install and operate.

SUMMARY OF THE INVENTION

In view of the foregoing background, it is therefore an object of the present invention to provide an air conditioning apparatus and related method for providing conditioned air having a low relative humidity despite a relatively large proportion of outside air in the inlet air flow.

It is another object of the present invention to provide an air conditioning apparatus and related method for providing conditioned air and operating at a relatively high efficiency.

It is yet another object of the present invention to provide an air conditioning apparatus and related method for providing conditioned air having relatively straightforward and reliable controls for implementing cooling and reheating, even for relatively low ambient air temperatures.

These and other objects, features and advantages according to the present invention are provided by an air conditioning apparatus comprising a subcooling heat exchanger for subcooling refrigerant being delivered to the evaporator and for reheating the air flow downstream from the evaporator; and a hot vapor heat exchanger, connectable in fluid communication with a refrigerant outlet of the compressor and positioned in the air flow downstream from the evaporator, for further reheating the air flow from the evaporator to further lower the relative humidity of the air flow. The subcooling heat exchanger is preferably connected in fluid communication with a refrigerant inlet of the evaporator and is positioned in the air flow downstream from the evaporator. The apparatus also preferably includes air handling means for generating an air flow over the evaporator to cool the air flow and remove moisture therefrom. The air leaving the apparatus may be delivered directly to the air conditioned space or via adjacent air ducts for delivering the conditioned air at predetermined temperature and humidity levels, even when substantially all of the inlet air is provided from outside air.

The air conditioning apparatus also preferably comprises hot vapor heat exchanger control means for selectively connecting the hot vapor heat exchanger in fluid communication with the refrigerant outlet of the compressor responsive to a sensed condition, such as a temperature or pressure. More particularly, the hot vapor heat exchanger control means may preferably include thermally modulated refrigerant flow control means for modulating hot refrigerant vapor flow through said hot vapor heat exchanger responsive to a sensed temperature. The hot vapor heat exchanger control means may include a solenoid valve connected in fluid communication between the hot vapor heat exchanger and the refrigerant outlet of the compressor, a thermostatic switch operatively connected to the solenoid valve for opening the solenoid valve when a temperature of air downstream from the hot vapor heat exchanger is below a predetermined temperature, and a check valve connected in fluid communication with the hot vapor heat exchanger. A humidistat may also be used to control the solenoid valve, either alone or in combination with a thermostatic switch.

The hot vapor heat exchanger control means may also further comprise a differential pressure control valve connected in fluid communication between the compressor and the condenser and across the hot vapor heat exchanger for further controlling reheating by the hot vapor heat exchanger when the solenoid valve is open. Accordingly, surges of refrigerant, as may be caused when the solenoid valve opens, may be reduced and uniformity of control thereby greatly improved. Moreover, the differential pressure valve provides a reliable and uncomplicated solution to controlling the additional reheating using a portion of the hot vapor from the compressor.

The air conditioning apparatus also preferably includes part load control means for cooling and reheating the air flow even at a relatively low temperature of air flow upstream of the evaporator. The part load control means may be provided by refrigerant vapor bypass means for selectively bypassing the condenser responsive to a sensed condition, such as a temperature associated with the evaporator. The part load control means may also be provided by varying compressor speed or by using cylinder unloading. In addition, the air conditioning apparatus also preferably includes condenser pressure control means associated with the condenser for maintaining a desired pressure at an outlet of the condenser.

A method aspect of the present invention is for operating an air conditioning apparatus comprising an evaporator, a condenser, and a compressor for circulating refrigerant through the condenser and the evaporator. The method preferably comprises the steps of: generating an air flow over the evaporator to cool the air flow, subcooling refrigerant being delivered to the evaporator and while reheating the air flow downstream from the evaporator to lower a relative humidity of the air flow, and selectively connecting a hot vapor heat exchanger in fluid communication with a refrigerant outlet of the compressor and positioned in the air flow downstream from the evaporator for further reheating the air flow from the evaporator to further lower the relative humidity of the air flow.

The step of selectively connecting the hot vapor heat exchanger preferably comprises selectively connecting the heat exchanger in fluid communication with the refrigerant outlet of the compressor responsive to a sensed condition. More particularly, the step of selectively connecting the hot vapor heat exchanger preferably comprises selectively connecting the heat exchanger in fluid communication with the refrigerant outlet of the compressor responsive to a sensed temperature of the evaporator which corresponds to air downstream from the heat exchanger being below a predetermined temperature. The method also preferably includes the step of controlling hot vapor refrigerant flow delivered to the hot vapor heat exchanger responsive to a differential pressure thereacross.

BRIEF DESCRIPTION OF THE PREFERRED EMBODIMENTS

DETAILED DESCRIPTION OF THE PREFERRED EMBODIMENTS

Figure 1:
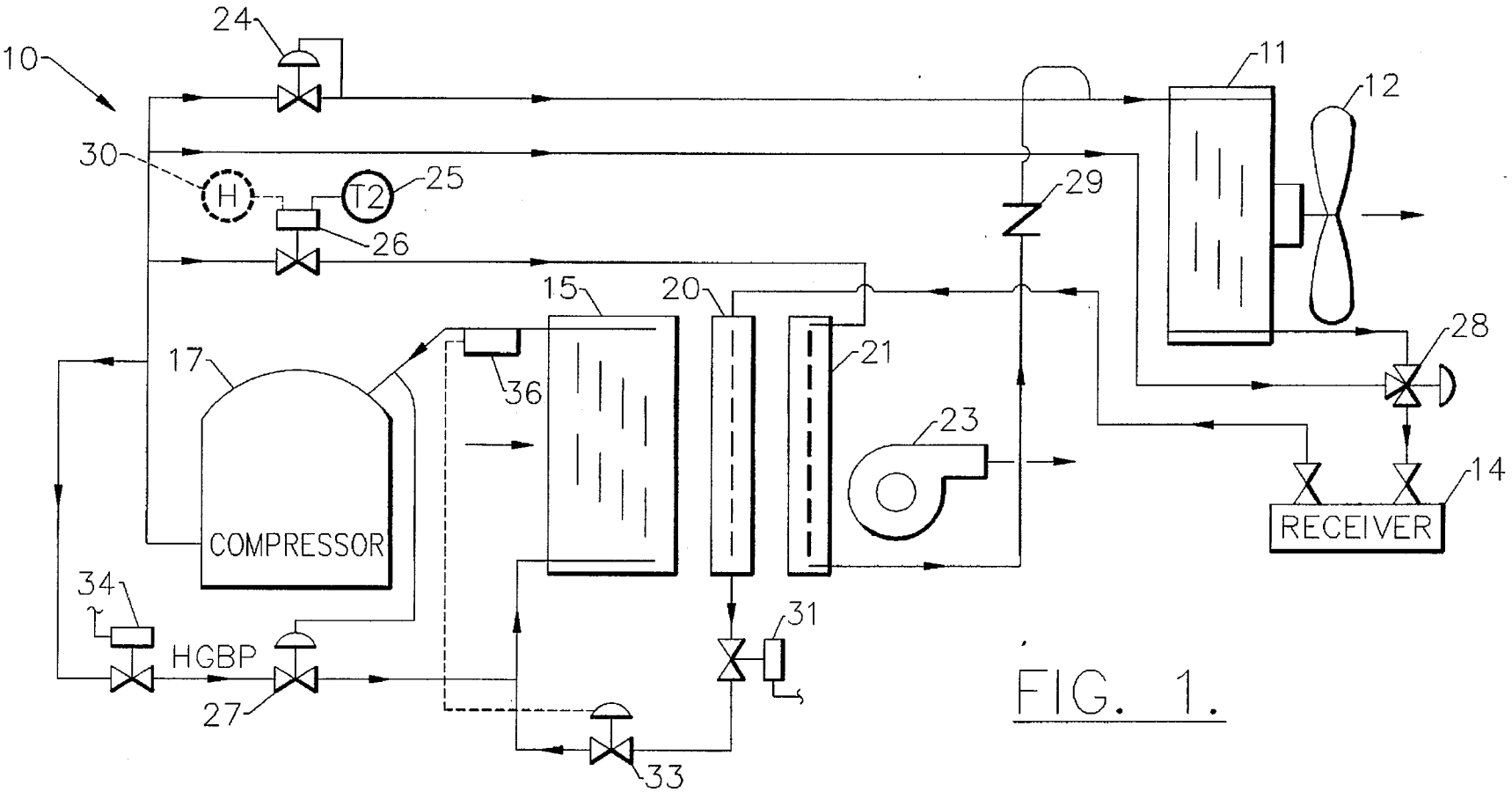
FIG. 1 is a schematic diagram of the air conditioning apparatus in accordance with the present invention.

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

The air conditioning apparatus 10 according to the invention is first described with reference to PIGS. 1 and 2. The apparatus 10 includes a condenser 11 and its associated blower 12, a refrigerant receiver 14, an evaporator 15, and a compressor 17 for recirculating refrigerant through the condenser and evaporator as would be readily understood by those skilled in the art. A filter 22 (FIG. 2) and blower 23 may be provided to clean and generate a flow of air over the evaporator 15 and other components as described in greater detail below.

In the illustrated embodiment, a first or subcooling heat exchanger 20 is provided for subcooling refrigerant delivered to the evaporator 15 and for reheating air after passage over the evaporator. The evaporator may collect water on its surfaces which is allowed to drain away. However, the air after passage over the evaporator 15, is still typically nearly saturated with moisture, especially when all or a large percentage of outside air is used. Accordingly, the subcooling heat exchanger 20 provides reheat to the air flow to thereby reduce its relative humidity as would be readily understood by those skilled in the art. Moreover, since the energy for reheating the air flow is also used to reduce the temperature of liquid refrigerant delivered to the evaporator 15, the energy for reheat is essentially energy free, in sharp contrast to conventional electric resistance reheating approaches which require additional energy for reheating.

The subcooling of liquid refrigerant also increases the effective performance of the compressor 17 and may produce an overall operating efficiency increase for the apparatus 10. For example, each 2° F. of subcooling enhances compressor 17 capacity by approximately 1%. Thus, the compressor capacity may be increased by 20% for 40° F. of additional subcooling. While the temperature of the liquid refrigerant is reduced by 40° F., the air temperature may be increased by 15° F. or more, thereby reducing the relative humidity to about 60% before it enters the second or hot vapor heat exchanger which, in turn, uses hot compressor vapor refrigerant from the compressor to provide additional reheat if required.

Both the first subcooling heat exchanger 20 and the second hot vapor heat exchanger 21 are connected directly in fluid communication with their corresponding portions of the refrigerant lines of the apparatus 10. In other words, intermediate heat exchangers, such as phase change heat exchangers, are not needed. Accordingly, a more reliable, uncomplicated and inexpensive system is provided by the air conditioning apparatus 10 of the present invention. In addition, overall operating efficiency of apparatus 10 may be higher.

The hot vapor heat exchanger 21 for reheating by hot vapor or gas is not typically required to be implemented until the outside or ambient temperature is 80° F. or less. An adjustable differential pressure valve 24 in the discharge line from the compressor 17 provides control of the quantity of hot refrigerant gas or vapor introduced into the hot vapor heat exchanger 21, such as when the illustrated discharge air thermostat 25 energizes reheat solenoid valve 26. A humidistat 30 may also be used to control the reheat solenoid valve 26 as would be readily understood by those skilled in the art. A check valve 29 is also preferably included in the refrigerant vapor line connected to the outlet of the second heat exchanger 21.

The differential valve 24 essentially controls the pressure drop of refrigerant vapor across the second heat exchanger 21 to prevent surges of hot refrigerant vapor from being diverted to the second heat exchanger when the solenoid valve 26 is activated. The setting of this differential valve 24 will control the leaving or conditioned air temperature, thereby eliminating the need for a relatively expensive proportional control valve and associated sensor as will be readily appreciated by those skilled in the art. The conditioned air temperature may readily be maintained within plus or minus 1° F. by the proper setting of the differential valve 24 and in cooperation with the solenoid valve 26 in accordance with the present invention.

As would also be readily understood by those skilled in the art, control of the condensing or head pressure of refrigerant is preferred. In the illustrated embodiment, an adjustable valve 28 in the liquid refrigerant line from the condenser 11 to the receiver 14 is provided to restrict refrigerant flow to maintain a preset condensing temperature. Other approaches, such as controlling the condenser blower 12 speed, cycling the blower, etc. may also be used to control the condenser temperature as would be readily understood by those skilled in the art.

Control of the air conditioning apparatus 10 for part load conditions is also typically desirable and readily implemented according to another aspect of the present invention. In particular, the air handling blower 23 may be operating continually. Accordingly, any cycling of the compressor 17 may result in ambient or outside air being introduced directly into the air conditioned space. The apparatus 10 according to the present invention maintains the cooling and reheating operations down to a relatively low ambient temperature, such as about 65° F. through the illustrated hot vapor bypass valve 27.

A shut-off solenoid valve 31 is provided which is moved to a closed positioned when the apparatus 10 is turned off. This valve is commonly known as a liquid line solenoid valve and its purpose is to prevent liquid refrigerant from migrating during the off cycle of the apparatus 10 as would be readily understood by those skilled in the art. Solenoid valve 34 is another shut-off valve in the hot vapor portion of the apparatus for also preventing refrigerant migration when the apparatus 10 is turned off. In addition, thermal expansion valve 33 is a refrigerant metering valve that controls the flow of expanding refrigerant into the evaporator 20 by sensing the temperature from sensing bulb 36, and for adjusting the flow of refrigerant to maintain a predetermined superheat as would also be readily understood by those skilled in the art.

Figure 2:
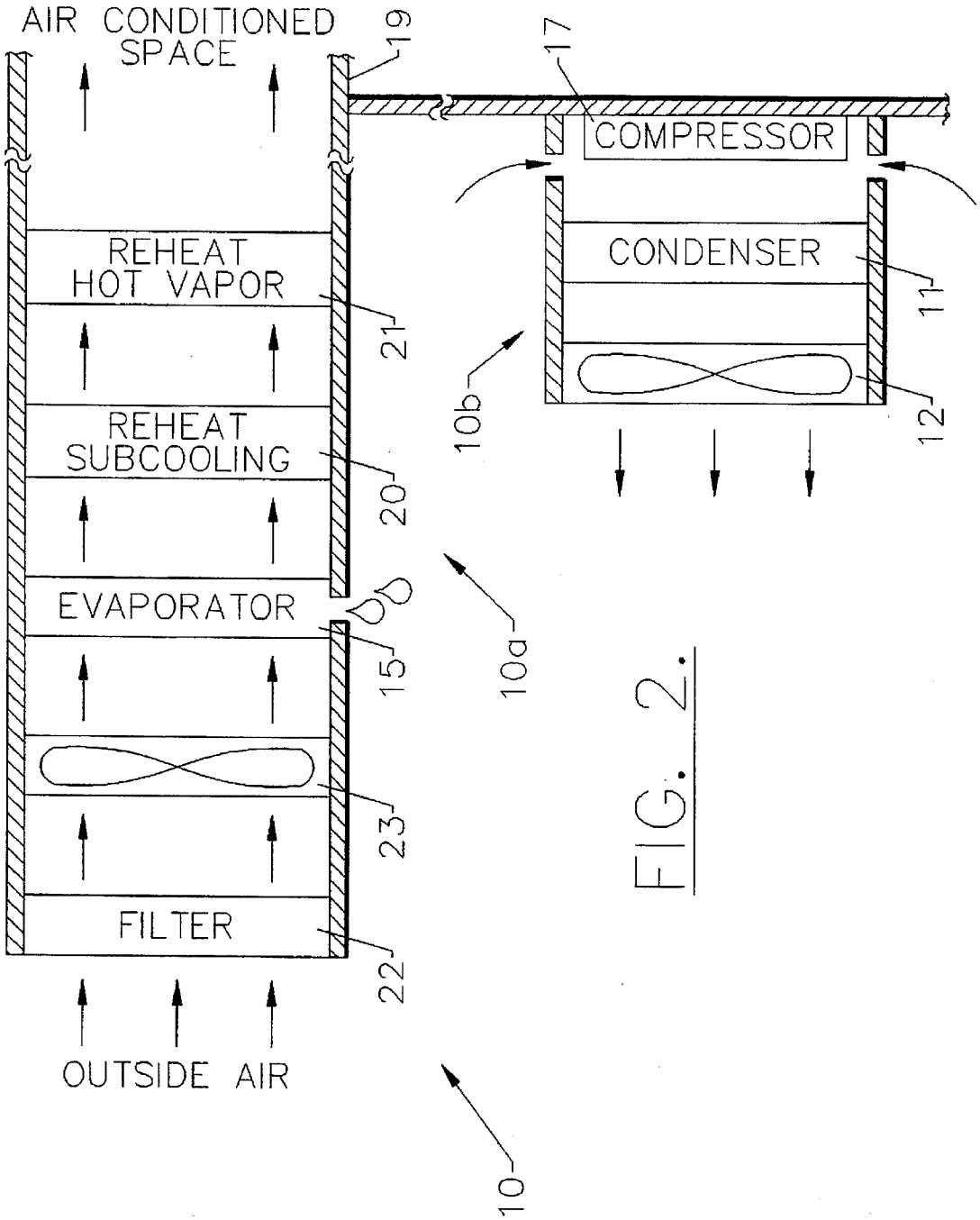
FIG. 2 is a schematic block diagram of the air conditioning apparatus according to the present invention illustrating a split configuration embodiment.

The air conditioning apparatus 10 according to the invention may be readily configured in a split system configuration including portions 10*a*, 10*b* as illustrated in FIG. 2. As would be readily understood by those skilled in the art, a single package configuration for the apparatus is also contemplated by the invention. The leaving or conditioned air may also be guided directly into the air conditioned space, or may be delivered to one or more desired areas within the air conditioned space by suitable ducts 19 (FIG. 2).

The present invention is particularly well suited to enable compliance with regulations requiring relatively large amounts of fresh air to be provided for each occupant. Accordingly, the air conditioning apparatus 10 may desirably supply completely all of its air from outside air as illustrated schematically in FIG. 2. For example, the blower 23 may desirably provide about 15 CFM per person of fresh conditioned air to comply with proposed government mandates. Thus, an exhaust opening, not shown, may be needed in another part of the conditioned space of the structure to allow stale air to exit. In addition, in sizing the air flow rate, care should be taken to avoid blowing water off of the evaporator coils, as would be readily understood by those skilled in the art. For example, an air flow rate of about 200 CFM may be desired for each ton of compressor 17 capacity when using outside air having a high relative humidity.

As would be readily understood by those skilled in the art, the apparatus 10 may also readily use return air or a mixture of outside air and return air. For example, duct work may be used to direct all or a portion of the exhaust air to the air intake of the air conditioning apparatus 10. For recirculating air which has a lower relative humidity, an air flow rate of 350 to 450 CFM may be used for each ton of compressor capacity. As would be readily understood by those skilled in the art, a combination of recirculating and full outside air units may be used to meet desired indoor air quality standards in an efficient and cost effective manner.

A method aspect of the present invention is for operating the air conditioning apparatus 10 comprising an evaporator 15, a condenser 11, and a compressor 17 for circulating refrigerant through the condenser and the evaporator. The method preferably comprises the steps of: generating an air flow over the evaporator 15 to cool the air flow, subcooling refrigerant being delivered to the evaporator and while reheating the air flow downstream from the evaporator to lower a relative humidity of the air flow, and selectively connecting a hot vapor heat exchanger 21 in fluid communication with a refrigerant outlet of the compressor 17 and positioned in the air flow downstream from the evaporator for further reheating the air flow from the evaporator to further lower the relative humidity of the air flow.

The step of selectively connecting the hot vapor heat exchanger 21 preferably comprises selectively connecting the heat exchanger in fluid communication with the refrigerant outlet of the compressor 17 responsive to a sensed condition. More particularly, the step of selectively connecting the hot vapor heat exchanger 21 preferably comprises selectively connecting the heat exchanger in fluid communication with the refrigerant outlet of the compressor 17 responsive to a sensed temperature associated with the evaporator 15. The method also preferably includes the step of controlling vapor flow delivered to the hot vapor heat exchanger 21 responsive to a differential pressure thereacross.

The following Examples 1 and 2 are illustrative of the present invention and are included for further understanding of the invention without limiting the invention.

EXAMPLE 1

Figure 3:
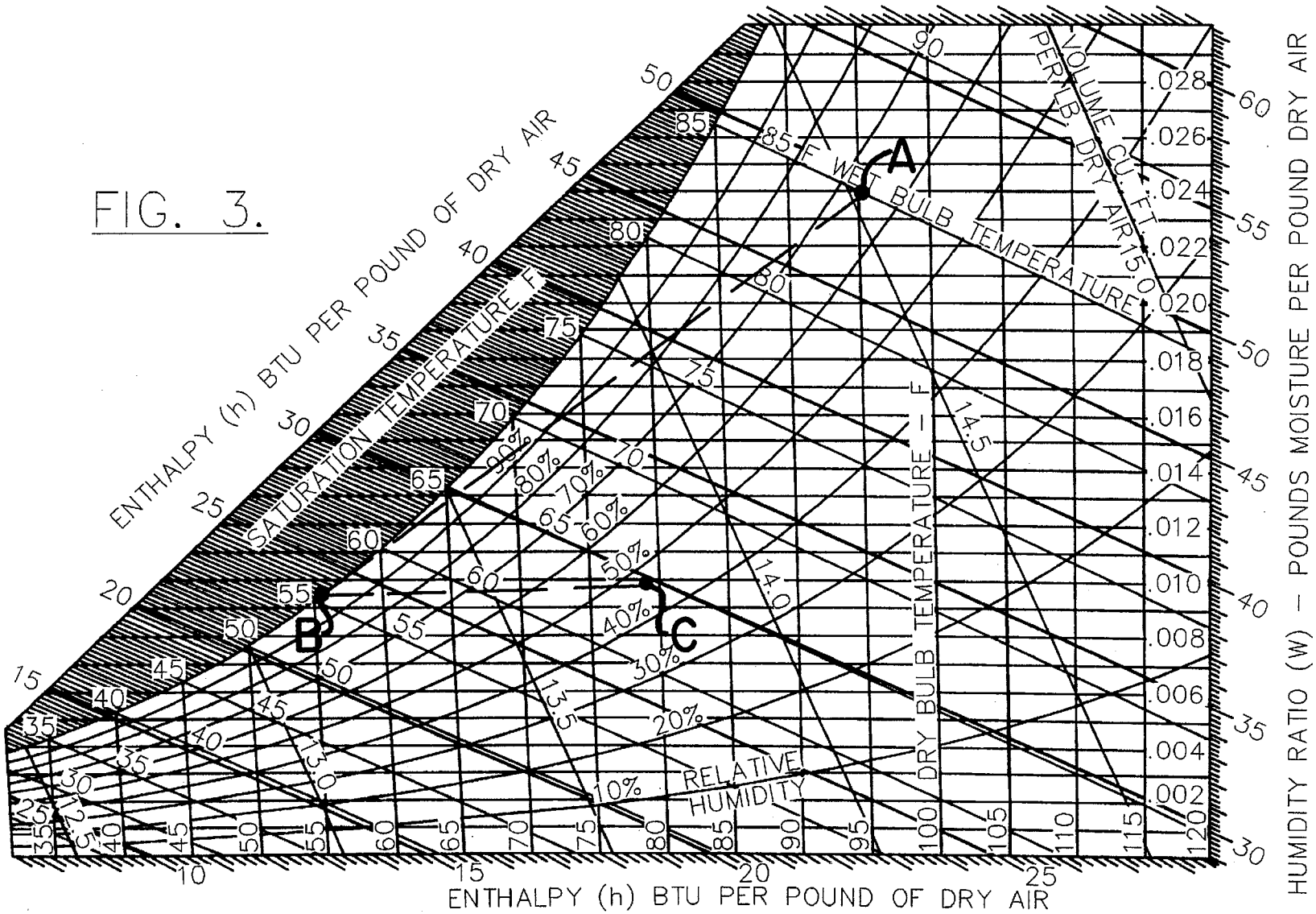
FIG. 3 is a psychometric chart including a plot of operation of the apparatus according to the present invention as described in Example 1.

An air conditioning apparatus as described above was operated under controlled conditions with 455 CFM of inlet air having a dry bulb temperature of 95.1° F. and a wet bulb temperature of 85.4° F., corresponding to a relative humidity of 68% labelled Point A on the psychometric chart of FIG. 3. The apparatus included a compressor 17, Copeland Model ZR40K3, an evaporator coil 15, Heatcraft Model 3CY1403DB 28×26, a condenser coil 11, Heatcraft Model 3EY1301D 32×80, a variable speed condenser fan motor control, Johnson Controls Co. Model P66AAB-6, a condenser fan motor and fan assembly 12 designed for variable speed consisting of Magnetek Model HE3H-7584E motor and Lauw fan blade T10H9.5 2225×½, a subcooling coil 20, Heatcraft Model 3C71201D 28×25, a hot gas reheat coil 21, Heatcraft Model 3CZ1201D 28×25, an evaporator blower assembly 23 consisting of a Morrison Blower Model 9-4 DD×½ and an A. O. Smith Motor Model F48F09B65P, a differential pressure control valve 24, Flocon Model A8AL ⅝×⅝, a hot gas bypass control valve 27, Alco Model CPHE 6, and other components as readily understood by those skilled in the art.

Under these conditions, air leaving the evaporator was 56.2° F. dry bulb and 56.1° F. wet bulb, corresponding to a relative humidity of 100% and labelled Point B on FIG. 3. Refrigerant temperature in the subcooling coil was reduced from 110° F. to 65° F., a reduction of 45° F. In addition, the heat from the subcooling coil heated the air from 56.2° F. saturated to a leaving dry bulb temperature of 78.3° F. and a wet bulb temperature of 65.0, corresponding to a relative humidity of 49% labelled Point C in FIG. 3. No additional reheat was needed from the hot vapor heat exchanger 21.

EXAMPLE 2

Figure 4:
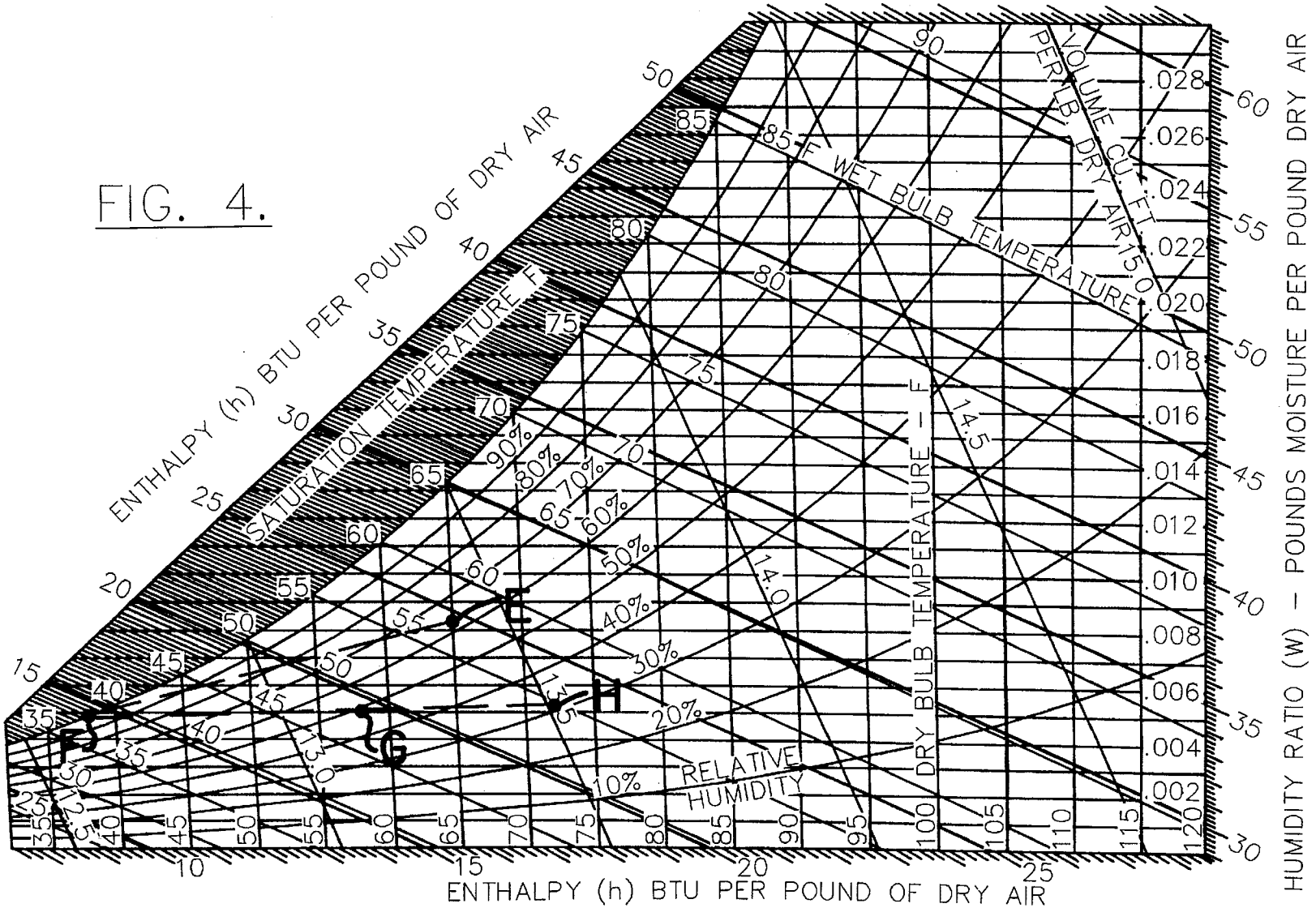
FIG. 4 is a psychometric chart including a plot of operation of the apparatus according to the present invention as described in Example 2.

The air condition apparatus described in EXAMPLE 1 may be even more effective at lower outside air temperatures. When operated under controlled conditions with 455 CFM of inlet air having a dry bulb temperature of 65° F. and a wet bulb temperature of 59.7° F., corresponding to a relative humidity of 74% (Point E of FIG. 4), air leaves the evaporator at 38° F. dry bulb and 100% relative humidity (Point F of FIG. 4). Refrigerant temperature in the subcooling coil is reduced from 83° F. to 41° F. The heat from this subcooling coil increases the air from 38° F. to a dry bulb temperature of 58° F. (Point G of FIG. 4). Additional heat from the hot vapor heat exchanger further heats the air to a dry bulb temperature of 72.1° F. and a wet bulb temperature of 54.9° F., corresponding to a relative humidity of 32% at Point H of FIG. 4.

The air conditioning apparatus 10 and related methods as described herein condition outside air, cooling and reheating the air to relative humidities of 50% or less without the use of energy wasting electric reheat. In addition, the reheat approaches in accordance with the present invention enable the use of a smaller compressor, increasing the energy efficiency by at least about 20%. Moreover, control of the leaving or conditioned air temperature is readily achieved by a thermostat energizing a solenoid valve which, in turn, introduces a portion of the hot compressor discharge vapor to a second heat exchanger 21, while the differential pressure valve 24 provides further stability of control. In other words, the controls for the air conditioning apparatus 10 are relatively inexpensive and uncomplicated, thereby increasing reliability while reducing installation and maintenance costs. Accordingly, many modifications and other embodiments of the invention will come to the mind of one skilled in the art having the benefit of the teachings presented in the foregoing descriptions and the associated drawings. Therefore, it is to be understood that the invention is not to be limited to the specific embodiments disclosed, and that modifications and embodiments are intended to be included within the scope of the appended claims.

That which is claimed is:

1. An air conditioning apparatus comprising:

an evaporator, a condenser, and a compressor for circulating refrigerant through said condenser and said evaporator, said evaporator having a refrigerant inlet, said compressor having a refrigerant outlet;

air handling means for generating an air flow over said evaporator to cool the air flow and remove moisture therefrom;

a subcooling heat exchanger, connected in fluid communication with the refrigerant inlet of said evaporator and positioned in the air flow downstream from said evaporator, for subcooling refrigerant being delivered to said evaporator and for reheating the air flow downstream from said evaporator to lower a relative humidity of the air flow; and a hot vapor heat exchanger, connectable in fluid communication with the refrigerant outlet of said compressor and positioned in the air flow downstream from said evaporator, for further reheating the air flow from said evaporator to further lower the relative humidity of the air flow.

2. An air conditioning apparatus according to claim 1 wherein said hot vapor heat exchanger is positioned in the air flow downstream from said subcooling heat exchanger.

3. An air conditioning apparatus according to claim 1 further comprising hot vapor heat exchanger control means for selectively connecting said hot vapor heat exchanger in fluid communication with the refrigerant outlet of said compressor responsive to a sensed condition.

4. An air conditioning apparatus according to claim 3 wherein said hot vapor heat exchanger control means comprises thermally modulated refrigerant flow control means for modulating hot refrigerant vapor flow through said hot vapor heat exchanger responsive to a sensed temperature.

5. An air conditioning apparatus according to claim 3 wherein said hot vapor heat exchanger control means comprises:

a solenoid valve connected in fluid communication between said hot vapor heat exchanger and the refrigerant outlet of said compressor; and a switch operatively connected to said solenoid valve for opening said solenoid valve responsive to at least one of a sensed temperature and a humidity of air downstream from said hot vapor heat exchanger.

6. An air conditioning apparatus according to claim 5 wherein said hot vapor heat exchanger control means further comprises a differential pressure control valve connected in fluid communication between said compressor and said condenser and across said hot vapor heat exchanger for further controlling reheating by said hot vapor heat exchanger when said solenoid valve is open.

7. An air conditioning apparatus according to claim 3 wherein said hot vapor heat exchanger control means further comprises a check valve connected in fluid communication with said hot vapor heat exchanger.

8. An air conditioning apparatus according to claim 1 further comprising condenser pressure control means associated with said condenser for maintaining a desired pressure at an outlet of said condenser.

9. An air conditioning apparatus according to claim 1 further comprising refrigerant vapor bypass means for selectively bypassing said condenser responsive to refrigerant pressure associated with said evaporator.

10. An air conditioning apparatus according to claim 1 further comprising duct means for delivering conditioned air to a conditioned space.

11. An air conditioning apparatus according to claim 1 wherein said air handling means comprises outside air inlet means for directing only outside air over said evaporator.

12. An air conditioning apparatus comprising:

an evaporator, a condenser, and a compressor for circulating refrigerant through said condenser and said evaporator, said compressor having a refrigerant outlet;

air handling means for generating an air flow over said evaporator to cool the air flow;

refrigerant subcool and air reheat means for subcooling refrigerant being delivered to said evaporator and for reheating the air flow downstream from said evaporator;

a hot vapor heat exchanger, connectable in fluid communication with the refrigerant outlet of said compressor and positioned in the air flow downstream from said evaporator, for further reheating the air flow from said evaporator; and hot vapor heat exchanger control means for selectively connecting said hot vapor heat exchanger in fluid communication with the refrigerant outlet of said compressor responsive to a sensed condition.

13. An air conditioning apparatus according to claim 12 wherein said refrigerant subcool and air reheat means comprises a subcooling heat exchanger positioned downstream from said evaporator and connected in fluid communication between said condenser and said evaporator.

14. An air conditioning apparatus according to claim 12 wherein said hot vapor heat exchanger control means comprises thermally modulated refrigerant flow control means for modulating hot refrigerant vapor flow through said hot vapor heat exchanger responsive to a sensed temperature.

15. An air conditioning apparatus according to claim 12 wherein said hot vapor heat exchanger control means comprises:

a solenoid valve connected in fluid communication between said hot vapor heat exchanger and the refrigerant outlet of said compressor; and a switch operatively connected to said solenoid valve for opening said solenoid valve responsive to at least one of a sensed temperature and a humidity of air downstream from said hot vapor heat exchanger.

16. An air conditioning apparatus according to claim 15 wherein said hot vapor heat exchanger control means further comprises a differential pressure control valve connected in fluid communication between said compressor and said condenser and across said hot vapor heat exchanger for further controlling reheating by said hot vapor heat exchanger when said solenoid valve is open.

17. An air conditioning apparatus according to claim 12 wherein said hot vapor heat exchanger control means further comprises a check valve connected in fluid communication with said hot vapor heat exchanger.

18. An air conditioning apparatus according to claim 12 wherein said hot vapor heat exchanger is positioned in the air flow downstream from said refrigerant subcool and air reheat means.

19. An air conditioning apparatus according to claim 12 further comprising refrigerant vapor bypass means for selectively bypassing said condenser responsive to refrigerant pressure associated with said evaporator.

20. An air conditioning apparatus according to claim 12 further comprising duct means for delivering conditioned air to a conditioned space.

21. An air conditioning apparatus according to claim 12 wherein said air handling means comprises outside air inlet means for directing only outside air over said evaporator.

22. An air conditioning apparatus according to claim 12 further comprising condenser pressure control means associated with said condenser for maintaining a desired pressure at an outlet of said condenser.

23. An air conditioning apparatus comprising:

an evaporator, a condenser, and a compressor for circulating refrigerant through said condenser and said evaporator, said compressor having a refrigerant outlet;

air handling means for generating an air flow over said evaporator to cool the air flow;

a hot vapor heat exchanger, connectable in fluid communication with the refrigerant outlet of said compressor and positioned in the air flow downstream from said evaporator, for reheating the air flow from said evaporator;

a solenoid valve connected in fluid communication with said hot vapor heat exchanger;

a thermostatic switch operatively connected to said solenoid valve for opening said solenoid valve responsive to a temperature of air downstream from said hot vapor heat exchanger being below a predetermined temperature; and a differential pressure control valve connected in fluid communication between said compressor and said condenser and across said hot vapor heat exchanger for further controlling reheating by said hot vapor heat exchanger when said solenoid valve is open.

24. An air conditioning apparatus according to claim 23 further comprising condenser pressure control means associated with said condenser for maintaining a desired pressure at an outlet of said condenser.

25. An air conditioning apparatus according to claim 23 wherein said air handling means comprises outside air inlet means for directing only outside air over said evaporator.

26. An air conditioning apparatus according to claim 23 further comprising a check valve connected in fluid communication with said hot vapor heat exchanger.

27. An air conditioning apparatus according to claim 23 further comprising part load control means for cooling and reheating the air flow even at a relatively low temperature of air flow upstream of said evaporator.

28. An air conditioning apparatus according to claim 27 wherein said part load control means comprises refrigerant vapor bypass means for selectively bypassing said condenser responsive to refrigerant pressure associated with said evaporator.

29. An air conditioning apparatus comprising:

an evaporator, a condenser, and a compressor for circulating refrigerant through said condenser and said evaporator, said evaporator having a refrigerant inlet, said compressor having a refrigerant outlet;

air handling means for generating an air flow over said evaporator to cool the air flow and remove moisture therefrom;

a subcooling heat exchanger, connected in fluid communication with the refrigerant inlet of said evaporator and positioned in the air flow downstream from said evaporator, for subcooling refrigerant being delivered to said evaporator and for reheating the air flow downstream from said evaporator to lower a relative humidity of the air flow;

a hot vapor heat exchanger, connectable in fluid communication with the refrigerant outlet of said compressor and positioned in the air flow downstream from said evaporator, for further reheating the air flow from said evaporator to further lower the relative humidity of the air flow; and hot vapor heat exchanger control means for selectively connecting said hot vapor heat exchanger in fluid communication with the refrigerant outlet of said compressor responsive to a sensed condition, said hot vapor heat exchanger control means comprising a solenoid valve connected in fluid communication between said hot vapor heat exchanger and the refrigerant outlet of said compressor, a switch operatively connected to said solenoid valve for opening said solenoid valve responsive to at least one of a sensed temperature and a humidity of air downstream from said hot vapor heat exchanger, and a differential pressure control valve connected in fluid communication between said compressor and said condenser and across said hot vapor heat exchanger for further controlling reheating by said hot vapor heat exchanger when said solenoid valve is open.

30. An air conditioning apparatus comprising:

an evaporator, a condenser, and a compressor for circulating refrigerant through said condenser and said evaporator, said evaporator having a refrigerant inlet, said compressor having a refrigerant outlet;

air handling means for generating an air flow over said evaporator to cool the air flow and remove moisture therefrom;

a subcooling heat exchanger, connected in fluid communication with the refrigerant inlet of said evaporator and positioned in the air flow downstream from said evaporator, for subcooling refrigerant being delivered to said evaporator and for reheating the air flow downstream from said evaporator to lower a relative humidity of the air flow;

a hot vapor heat exchanger, connectable in fluid communication with the refrigerant outlet of said compressor and positioned in the air flow downstream from said evaporator, for further reheating the air flow from said evaporator to further lower the relative humidity of the air flow; and hot vapor heat exchanger control means for selectively connecting said hot vapor heat exchanger in fluid communication with the refrigerant outlet of said compressor responsive to a sensed condition, said hot vapor heat exchanger control means comprising a check valve connected in fluid communication with said hot vapor heat exchanger.

31. A method for operating an air conditioning apparatus comprising an evaporator, a condenser, and a compressor for circulating refrigerant through the condenser and the evaporator, said method comprising the steps of:

generating an air flow over the evaporator to cool the air flow;

subcooling refrigerant being delivered to the evaporator and while reheating the air flow downstream from the evaporator to lower a relative humidity of the air flow; and selectively connecting a hot vapor heat exchanger in fluid communication with a refrigerant outlet of the compressor and positioned in the air flow downstream from the evaporator for further reheating the air flow from the evaporator to further lower the relative humidity of the air flow.

32. A method according to claim 31 wherein the step of selectively connecting the hot vapor heat exchanger comprises selectively connecting the hot vapor heat exchanger in fluid communication with the refrigerant outlet of the compressor responsive to a sensed condition.

33. A method according to claim 31 wherein the step of selectively connecting the hot vapor heat exchanger comprises selectively connecting the hot vapor heat exchanger in fluid communication with the refrigerant outlet of the compressor responsive to a sensed condition.

34. A method according to claim 33 further comprising the step of selectively bypassing the condenser responsive to a refrigerant pressure associated with the evaporator.

35. A method according to claim 31 further comprising the step of modulating hot refrigerant vapor flow through the hot vapor heat exchanger responsive to a sensed temperature.

36. A method according to claim 31 further comprising the step of controlling hot refrigerant vapor flow delivered to the hot vapor heat exchanger responsive to a differential pressure thereacross.

37. A method according to claim 31 further comprising the step of maintaining a desired pressure at an outlet of the condenser.

38. A method according to claim 31 further comprising the step of delivering conditioned air to a conditioned space via one or more air delivery ducts.

39. A method according to claim 31 further comprising the step of directing only outside air over the evaporator.

40. An air conditioning apparatus comprising:

an evaporator, a condenser, and a compressor for circulating refrigerant through said condenser and said evaporator, said evaporator having a refrigerant inlet, said compressor having a refrigerant outlet;

air handling means for generating an air flow over said evaporator to cool the air flow and remove moisture therefrom;

a subcooling heat exchanger, connected in fluid communication with the refrigerant inlet of said evaporator and positioned in the air flow downstream from said evaporator, for subcooling refrigerant being delivered to said evaporator and for reheating the air flow downstream from said evaporator to lower a relative humidity of the air flow;

a hot vapor heat exchanger, connectable in fluid communication with the refrigerant outlet of said compressor and positioned in the air flow downstream from said evaporator, for further reheating the air flow from said evaporator to further lower the relative humidity of the air flow; and condenser pressure control means associated with said condenser for maintaining a desired pressure at an outlet of said condenser.

* * * * *